US006886262B2

(12) United States Patent
Ohtsubo et al.

(10) Patent No.: US 6,886,262 B2
(45) Date of Patent: May 3, 2005

(54) RAZOR AND ITS HANDLE

(75) Inventors: Hiroshi Ohtsubo, Seki (JP); Kazuhiko Isogimi, Inuyama (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 0 days.

(21) Appl. No.: 10/714,140

(22) Filed: Nov. 14, 2003

(65) Prior Publication Data

US 2004/0093735 A1 May 20, 2004

(30) Foreign Application Priority Data

Nov. 18, 2002 (JP) ..... 2002-333746

(51) Int. Cl.[7] ..... B26B 21/52
(52) U.S. Cl. ..... 30/526; 30/50
(58) Field of Search ..... 30/526, 50; 16/430; 15/167.1

(56) References Cited

U.S. PATENT DOCUMENTS 5,027,511 A * 7/1991 Miller ..... 30/526
2002/0026720 A1 * 3/2002 Ferraro ..... 30/526

FOREIGN PATENT DOCUMENTS

JP 42-76499 11/1968
JP 54-004538 1/1979
JP 53-72303 11/1981

* cited by examiner

*Primary Examiner*—Douglas D Watt
(74) *Attorney, Agent, or Firm*—Stetina Brunda Garred & Brucker

(57) ABSTRACT

A razor handle includes a hard section and a soft section integrally formed and overlapping each other. On the rear surface of a gripping section, a second rear contact section of the soft section is exposed and a finger applying concave section is formed at the upper section of the second rear contact section. On the front surface of the gripping section, the first front contact section of the hard section is exposed at the boundary section with a side surface, the second front contact section of the soft section is exposed between the first front contact sections at the both boundary sections, and a concave area is formed on the upper section of the second front contact section. On the side surface of the gripping section, the second side contact section of the soft section continues from the second rear contact section and is exposed at the boundary section with the rear surface, and the first side contact section of the hard section is continued from the first front contact section and is exposed at the boundary section with the front surface.

8 Claims, 3 Drawing Sheets

RAZOR AND ITS HANDLE

BACKGROUND OF THE INVENTION

The present invention relates to a razor and its handle.

Razors and their handles are disclosed in the official gazettes of Japanese Examined Utility Model Publication No. 43-28104, Japanese Utility Model Laid-Open No. 55-105072, and Japanese Examined Utility Model Publication No. 56-49564, which are known conventional razors and handles.

The razor disclosed in the official gazette of Japanese Examined Utility Model Publication No. 43-28104 has a blade and a handle extending in the longitudinal direction and a plurality of cleats formed on the handle.

The razor disclosed in the official gazette of Japanese Utility Model Laid-Open No. 55-105072 has a plastic handle extending in the longitudinal direction and a razor head extending in a direction orthogonal to the handle and a metallic reinforcement plate for providing a heavy feeling when the razor is used as set with the handle.

The razor disclosed in the official gazette of Japanese Examined Utility Model Publication No. 56-49564 has a plastic handle extending in the longitudinal direction and a razor head extending in a direction orthogonal to the handle and a fitting body for providing a weighty feeling when the razor is used as a set with the handle. The fitting body is made of a material obtained by mixing metallic powder with a metal, ceramic, glass, or plastic.

To easily perform shaving with any one of the above razors, it is preferable to design it by considering the following points.

1. To enable the direction of the gripping section of the razor to be easily changed in person's palm;

2. To improve stability when a person is holding the gripping section with the palm of their hand;

3. To make it possible to shave person's face downward so as to bring the gripping section close to the face 4. To improve the feel of the razor against the person's skin when gripping the razor; and 5. To improve shaving performance.

SUMMARY OF THE INVENTION

It is an object of the present invention to make shaving easy by variously improving a razor while considering the above design points on the basis of human factors engineering.

To achieve the foregoing and other objectives and in accordance with the purpose of the present invention, a razor for shaving a skin surface having a razor head, a blade, and a handle is provided. The razor head includes a side. The blade includes a blade edge disposed along the side of the razor head. The handle has a front surface at the same side as the blade edge of the razor head, a rear surface opposite to the front surface, and a side surface between the front surface and the rear surface, in which a gripping section linearly extending in the range from the upper section of the side close to the blade edge up to the lower section of the side far from the blade edge are formed on the handle. The entire length along the longitudinal direction of the gripping section and including the razor head and the handle is L, and L satisfies the relation of 108 mm≦L≦138 mm. The entire width between both ends of the razor head in the cross direction of the blade edge is W, and W satisfies the relation of 34 mm≦W≦44 mm. The angle formed between the shaving tangential plane on the razor head when applying the razor head to a skin surface together with the blade edge and a plane including the center line in the longitudinal direction of the gripping section of the handle is θ, and θ satisfies the relation of 11°≦θ≦33°. The maximum distance in the cross direction between the front surface and the rear surface of two directions orthogonal to each other on a cross section orthogonal to the longitudinal direction of the gripping section of the handle is DX, and the maximum distance in the cross direction between both side surfaces is DY, DX satisfies the relation of 9.5 mm≦DX≦13.5 mm and DY satisfies the relation of 9 mm≦DY≦13 mm. The whole mass including the razor head and the handle is M, and M satisfies the relation of 8.5 g≦M≦11.5 g.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a sectional view of the handle in FIG. 1(*a*);

FIG. 1(*c*) is a sectional view showing a replaceable blade cartridge of the razor in FIG. 1(*a*);

FIG. 2(*b*) is a partially cut-out back view showing the handle of the razor in FIG. 1(*a*);

FIG. 3(*b*) is a sectional view taken along the line 3(*b*)—3(*b*) in FIG. 2(*a*);

FIG. 3(*c*) is a sectional view taken along the line 3(*c*)—3(*c*) in FIG. 2(*a*); and FIG. 3(*d*) is a sectional view taken along the line 3(*d*)—3(*d*) in FIG. 2(*a*).

DETAILED DESCRIPTION OF THE PREFERRED EMBODIMENTS

Figure 1:
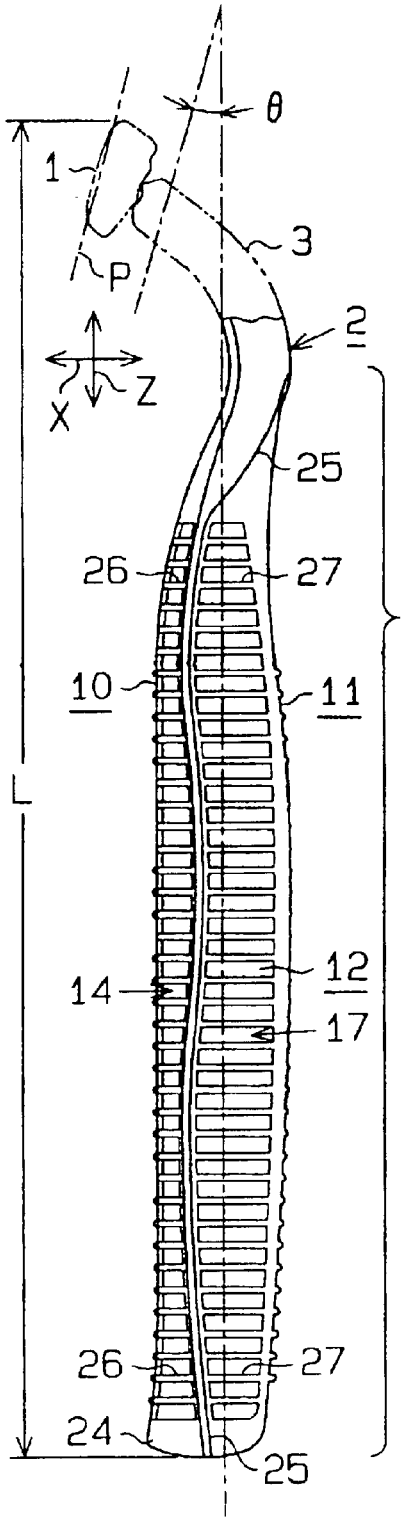
FIG. 1(*a*) is a partially cut-out side view of the handle of a razor of the present embodiment.
Figure 1:
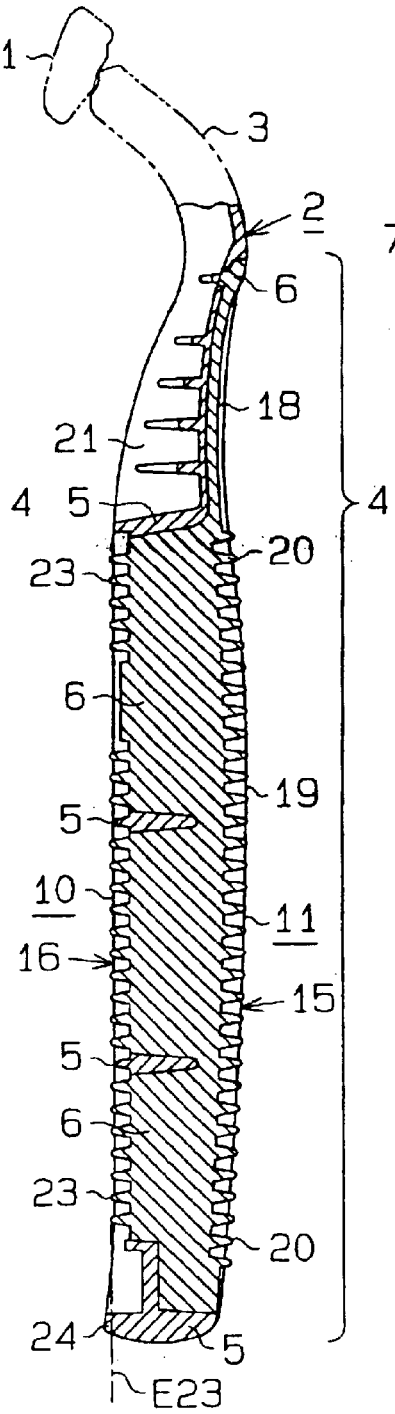
Figure 1:
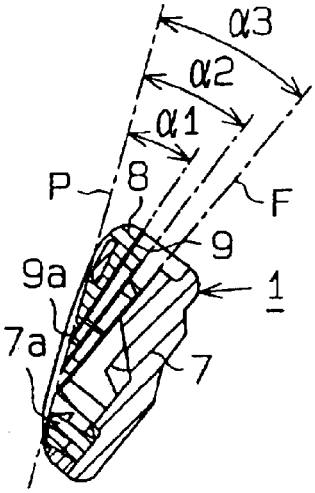
Figure 2A:
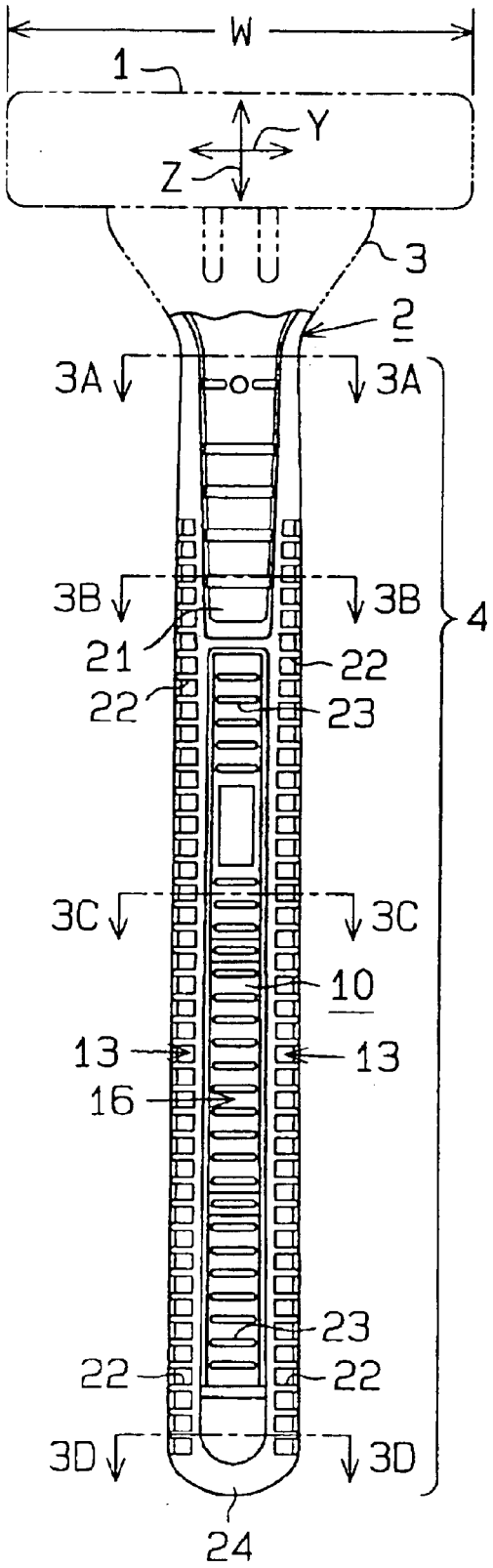
FIG. 2(*a*) is a partially cut-out front view showing the handle of the razor in FIG. 1(*a*)
Figure 2B:
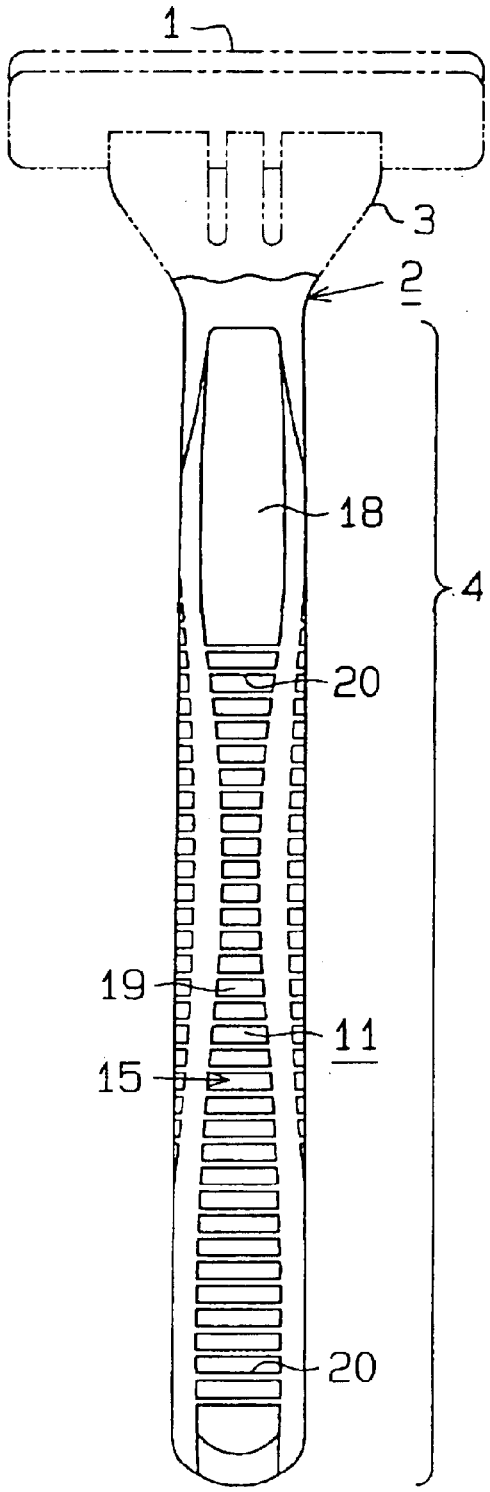
Figure 3A:
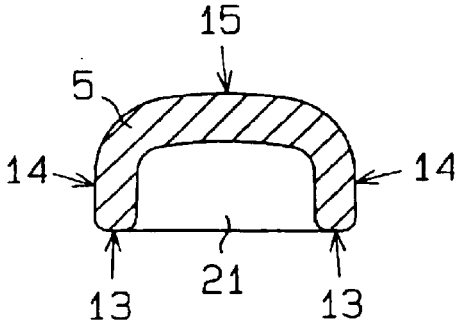
FIG. 3(*a*) is a sectional view taken along the line 3(*a*)—3(*a*) in FIG. 2(*a*)
Figure 3B:
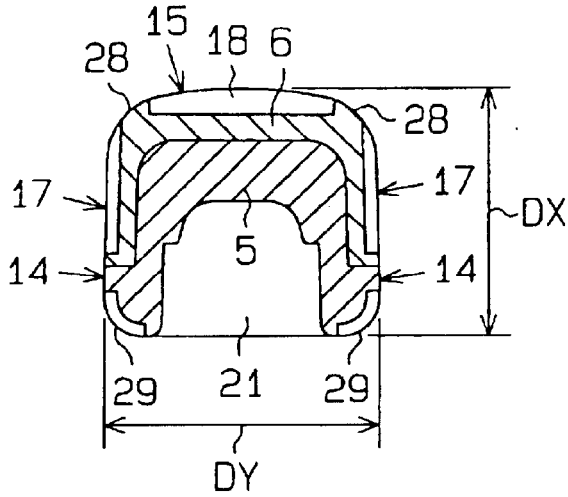
Figure 3C:
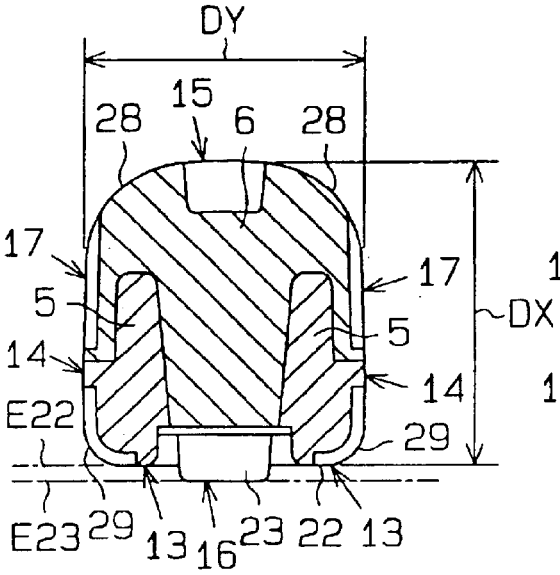
Figure 3D:
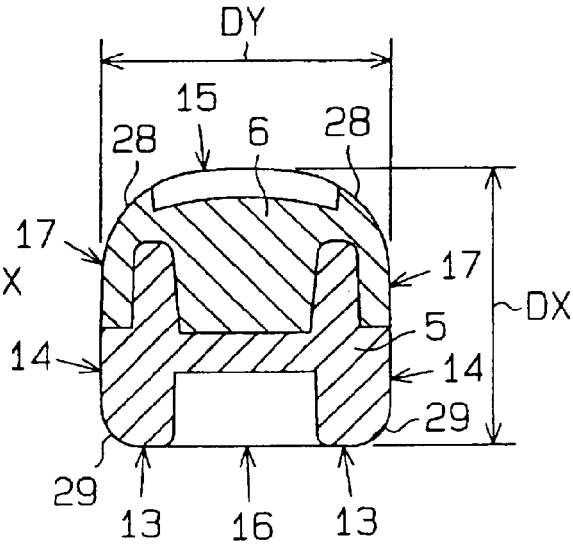

A razor of an embodiment of the present invention is described below by referring to FIG. 1(*a*) to FIG. 3(*d*).

The razor is provided with not only a replaceable blade cartridge 1 (razor head) but also a handle 2 having a head 3 by which the replaceable blade cartridge 1 is removably supported and a gripping section 4. The replaceable blade cartridge 1 transitions from an illustrated neutral state and enters a pivotable state by tilting clockwise up to approximately 45° as shown in FIG. 1(*b*) from the neutral state when the cartridge 1 is used. It is also possible to fix the razor head 1 to the head 3 of the handle 2.

The head 3 of the handle 2 is constituted by a hard section 5. The gripping section 4 of the handle 2 is constituted by the hard section 5 integrally extended from the head 3, and a soft section 6 lower in hardness than the hard section 5. The hard section 5 and soft section 6 are integrally formed and overlapped with each other. To fabricate the handle 2, a resin (for example, hard resin such as ABS) injected into a molding die (not illustrated) as a first material to form the hard section 5 of the head 3 and the hard section 5 of the gripping section 4. Then, only a part of the molding die is changed while leaving the hard section 5 in the molding die and a resin (for example, soft resin, such as an elastomer) is injected into the molding die as a second material to form the soft section 6 of the gripping section 4.

In the case of the replaceable blade cartridge 1, each blade body 9 is held between a blade bed 7 and a top plate 8. When applying a guard 7*a*, present before the blade bed 7 and the top plate 8, to a skin surface together with a blade edge 9*a* of each blade body 9, a shaving tangential plane P is set. The plane P is a plane for connecting the upside of the guard 7*a* of the blade bed 7 with the upside of the top plate 8 by passing through the vicinity of the blade edge 9*a* of each blade body 9.

The gripping section 4 of the handle 2 linearly extends in the range from the upper section of the side of the blade body 9 close to the blade edge 9*a* up to the lower section of the side of the blade body 9 far from the blade edge 9*a*. The gripping section 4 has a front surface 10 located at the same side as the blade edge 9*a*, a rear surface 11 located at the opposite side to the front surface 10, and side surfaces 12 between the front surface 10 and the rear surface 11. The front surface 10, rear surface 11, and side surfaces 12 are extended along the longitudinal direction Z of the gripping section 4.

The hard section 5 includes a first front contact section 13 exposed at the front surface 10 of the gripping section 4 and a first side contact section 14 exposed at both side surfaces 12 of the gripping section 4. The soft section 6 includes a second rear contact section 15 exposed at the rear surface 11 of the gripping section 4, a second front contact section 16 exposed at the front surface 10 of the gripping section 4, and a second side contact section 17.

The second rear contact section 15 of the soft section 6 is extended over the rear surface 11 of the gripping section 4 along the longitudinal direction Z. A shallow, finger applying concave section 18 with no ruggedness is formed on the upper section of the side of the second rear contact section 15 close to the blade edge 9*a*. A finger applying surface 19 having a plurality of cleat protrusions 20 is formed on the lower section of the rear of the section 15, far from the finger applying concave section 18, to the blade edge 9*a*.

On the front surface 10 of the gripping section 4, the first front contact section 13 of the hard section 5 is extended in the longitudinal direction Z of the gripping section 14 so as to be located at the boundary section (corner section) with the side surfaces 12. At the upper section of the front close to the blade edge 9*a*, a concave area 21 is extended in the longitudinal direction Z between both first front contact sections 13. Both first front contact sections 13 respectively have a plurality of cleat protrusions 22 in the range from the upper section of the front close to the blade edge 9*a* up to the lower section of the front far from the blade edge 9*a*. Moreover, on the front surface 10 of the gripping section 4, the second front contact section 16 of the soft section 6 is extended in the longitudinal direction Z in the range from the concave area 21 up to the lower section of the front so as to be located between both first front contact sections 13. The second front contact section 16 has a plurality of cleat protrusions 23 in the range from the concave area 21 up to the lower section of the front.

As shown in FIGS. 1(*b*) and 3(*c*), a virtual surface E23 connecting the cleat protrusions 23 of the second front contact section 16 to each other has the same height as a virtual surface E22 connecting the cleat protrusions 22 of both first front contact sections 13 to each other or protrudes from the virtual surface E22. A finger hooking section 24 which is the hard section 5 is formed at the bottom end of the front surface 10 so as to protrude beyond the cleat protrusions 23 of the second front contact section 16.

As shown in FIG. 1(*a*), on the side surfaces 12 of the gripping section 4, at the boundary section between the side surfaces 12 and the front surface 10, the first side contact section 14 of the hard section 5 continued from the first front contact sections 13, the second side contact section 17 of the soft section 6 continued from the second rear contact section 15 at the boundary section (corner section) with the rear surface 11, and a boundary section 25 meandered between the first side contact section 14 and the second rear contact section 15, are extended along the longitudinal direction Z.

The first side contact section 14 and the second side contact section 17 respectively have a plurality of cleat protrusions 26 and 27 in the range from the side close to the blade edge 9*a* up to the side far from the blade edge 9*a*. As clarified from the cross section orthogonal to the longitudinal direction Z in the gripping section 4, rounded surfaces (R surfaces) 28 and 29 are extended along the longitudinal direction Z at the boundary section between the second rear contact section 15 and the second side contact section 17 and the boundary section between the first front contact sections 13 and the first side contact sections 14 of the side surfaces 12.

As described above, the razor is provided with a handle 2 with the front surface 10 at the same side as the blade edge 9*a* of the razor head 1, the rear surface 11 at the opposite side to the front surface 10, and the side surfaces 12 between the front surface 10 and rear surface 11. The gripping section 4 is formed on the handle 2 linearly extending in the range from the side close to the blade edge 9*a* up to the side far from the blade edge 9*a*. In this case, the term "linearly" denotes that the central section on cross sections between the front surface 10, rear surface 11, and side surfaces 12 almost linearly extends, independently of the geometry of these surfaces 10, 11, and 12. Thus, when the gripping section 4 linearly extends, it is possible to easily change directions of the gripping section 4 in a person's palm and the stability in gripping the gripping section 4 in the palm is improved.

To express the entire length including the razor head 1 and the handle 2 in the longitudinal direction Z of the gripping section 4 as L, L is set so as to satisfy the relation of 108 mm$\leqq$L$\leqq$138 mm. The stability while gripping the gripping section 4 by a person's palm is improved and moreover, it is possible to easily change directions of the gripping section 4 in the user's palm.

To express the entire width between both ends of the razor head 1 in the cross direction Y of the blade edge 9*a* as W, W is set so as to satisfy the relation of 34 mm≦W≦44 mm. The stability while applying the razor head 1 to a person's face is improved and it is easy to change directions of the gripping section 4 in a user's palm.

As shown in FIG. 1(*a*), assuming that θ is the angle formed between the shaving tangential plane P on the razor head 1 when applying the razor head 1 to a skin surface together with the blade edge 9*a* and the plane including the center line of the gripping section 4 of the handle 2 in the longitudinal direction Z, θ is set so as to satisfy the relation of 11°≦θ≦33°. Because the gripping section 4 turns downward at the optimum angle θ from a person's face while applying the razor head 1 to the face, it is possible to shave the face downward by making the gripping section 4 approach the face.

As shown in FIG. 3(*c*), assuming that the maximum distance is DX in the axial direction X between the front surface 10 and rear surface 11 out of two directions (X,Y) orthogonally crossing each other on a cross section orthogonal to the longitudinal direction Z of the gripping section 4, and that the maximum distance is DY in the direction Y between the side surfaces 12, DX and DY are set so as to satisfy the relation of 9.5 mm≦DX≦13.5 mm and the relation of 9 mm≦DY≦13 mm, respectively. Thus, the stability when gripping the gripping section 4 by a person's palm is improved in accordance with the optimum cross sectional dimensions (maximum distances DX and DY) and it is also possible to easily change directions of the gripping section 4 in a user's palm.

Assuming the whole mass including the razor head 1 and handle 2 is M, M is set so as to satisfy the relation of 8.5 g≦M≦11.5 g. The stability while gripping the gripping section 4 by a person's palm is improved in accordance with the optimum mass M and it is possible to easily change directions of the gripping section 4 in a user's palm. Moreover, shaving performance is improved in accordance with the dead weight.

Therefore, the present invention makes it possible to easily perform shaving because of the above various improvements.

Moreover, a razor of the present invention is provided with the handle 2 having the front surface 10, rear surface 11, and side surfaces 12. The handle 2 is provided with the gripping section 4 extending in the range from the upper section of the side close to the blade edge 9*a* up to the lower section of the side far from the blade edge 9*a*.

In the case of the rear surface 11, the finger applying concave section 18 is formed at the upper section of the rear close to the blade edge 9*a*, and the rear contact section 15 is formed in the range from the finger applying concave section 18 up to the lower section of the rear far from the blade edge 9*a*. With the finger applying concave section 18, the position of the rear surface 11 to which fingers are applied while gripping the gripping section 4 by a person's palm can be easily specified and the stability while in the gripping state is improved.

In the case of the front surface 10, the concave area 21 extending in the longitudinal direction Z of the gripping section 4 is formed at the upper section of the front close to the blade edge 9*a* and the front contact sections 13 and 16 are formed in the range from the concave area 21 up to the lower section of the front far from the blade edge 9*a*. The weight balance with the razor head 1 is improved by the concave area 21 because the center of gravity of the gripping section 4 is moved to the lower section and the stability while gripping the gripping section 4 by a user's palm is improved.

In the case of the side surfaces 12, the side contact sections 14 and 17 are formed in the range from the side upper section of the side close to the blade edge 9*a* up to the side lower section of the side far from the blade edge 9*a*. In the case of the gripping section 4, rounded surfaces (R surfaces) 28 and 29 are extended along the longitudinal direction Z at the boundary section between rear surface 11 and the side surfaces 12 and the boundary section between the front surface 10 and the side surfaces 12 on the cross section orthogonal to the longitudinal direction Z at the gripping section 4. It is possible to easily change directions of the gripping section 4 in a user's palm because of these R surfaces 28 and 29.

The cleat protrusions 20, 22, 23, 26, and 27 are formed in parallel along the longitudinal direction Z at the rear contact section 15, front contact sections 13 and 16, and side contact sections 14 and 17. A user's fingers do not easily slip on these cleat protrusions 20, 22, 23, 26, and 27 while gripping the gripping section 4 by the user's palm and stability in the gripping state is improved.

The razor handle 2 is provided with the hard section 5 including the first contact sections 13 and 14 formed by a first material and the soft section 6 including the second contact sections 15, 16, and 17 formed by a second material softer than the first material. The front surface 10 to which the blade edge 9*a* of the razor turns, the rear surface 11 at the rear opposite to the front surface 10, and the side surfaces 12 between the front surface 10 and rear surface 11 are extended in the longitudinal direction Z in the range from the upper section of the side close to the blade edge 9*a* up to the lower section at the side far from the blade edge 9*a*.

In the case of the rear surface 11, the second rear contact section 15 of the soft section 6 is extended in the longitudinal direction Z by exposing the section 15. In the case of the front surface 10, the front contact section 13 of the hard section 5 is extended in the longitudinal direction Z by exposing the section 13 at the boundary section with the side surfaces 12. The second front contact section 16 of the soft section 6 is exposed and extended in the longitudinal direction Z in the space with the first front contact section 13.

In the case of the side surfaces 12, the second side contact section 17 of the soft section 6 continued from the second rear contact section 15 is extended in the longitudinal direction Z by exposing the section 17 at the boundary section with the rear surface 11. Moreover, in the case of the side surfaces 12, the first side contact section 14 of the hard section 5 continued from the first front contact section 13 is extended in the longitudinal direction Z by exposing the section 14 at the boundary section with the front surface 10. A boundary section 25 between the second side contact section 17 and the first side contact section 14 is extended in the longitudinal direction Z by exposing the section 25.

In the case of this embodiment, the second rear contact section 15 and second side contact section 17 of the soft section 6 are exposed in the range from the rear surface 11 facing a user's palm up to the side surfaces 12 held by both fingers of the user's palm, and the second front contact section 16 is exposed to the front surface 10 to which the fingers of the user's palm are applied in the gripping state while gripping the gripping section 4 by the user's palm. Therefore, it is possible to improve the feel of the gripping section 4 against one's skin. Moreover, because the first side contact section 14 and the both first front contact sections 13 of the hard section 5 are exposed in the range from the side surfaces 12 held by both fingers while gripping the gripping section 4 up to the front surface 10, stability in the gripping state is improved. Therefore, it is possible to make shaving easy.

The hard section 5 including the first front contact section 13 and the first side contact section 14 is integrally formed. The soft section 6 including the second rear contact section 15, second front contact section 16, and second side contact section 17 is integrally formed. The hard section 5 and soft section 6 are overlapped with each other. Therefore, it is possible to raise the strength of the handle 2 by improving the adhesiveness between the hard section 5 and soft section 6.

The finger applying concave section 18 is formed at the upper section of the rear close to the blade edge 9*a* of the razor 9*a* of the second rear contact section 15. The position of the rear surface 11 to which the user's fingers are applied while gripping the gripping section 4 by the user's palm can be easily specified and stability in the gripping state is improved by the finger applying section 18.

The concave area 21 extending in the longitudinal direction Z between the first front contact sections 13 is formed on the hard section 5 at the upper section of the front close to the blade edge 9*a* of the razor. The weight balance can be easily obtained because the center of gravity of the gripping section 4 is moved to the lower side and the stability while gripping the gripping section 4 by a palm is improved by the concave area 21.

The cleat protrusions 20, 22, 23, 26, and 27 are formed on the second rear contact section 15, first front contact section 13, second front contact section 16, second side contact section 17, and first side contact section 14 respectively. A user's fingers do not easily slip while gripping the gripping section 4 by the user's palm due to these cleat protrusions 20, 22, 23, 26, and 27 and stability in the gripping state is improved.

The cleat protrusion 23 of the second front contact section 16 protrudes beyond the height of the virtual surface E22 connecting the cleat protrusions 22 of the first front contact sections 13 to each other at both boundary sections. In this case, it is possible to securely bring out the function of the second front contact section 16 such as the cleat function on the front surface 10.

The finger hooking section 24 is formed at the bottom end of the side far from the blade edge 9*a* on the front surface 10 of the handle 2. In this case, a user's fingers do not easily slip while gripping the gripping section 4 by the user's palm due to the finger hooking section 24 and stability in the gripping state is improved.

Moreover, assuming that shaving angles formed between a virtual plane F, including the direction orthogonal to the thickness direction of the blade body 9 and passing through each blade edge 9*a* and the shaving tangential plane P are $\alpha 1$, $\alpha 2$, and $\alpha 3$, it is preferable to set these angles so as to satisfy the relations of $15° \leqq \alpha 1 \leqq 22°$, $15° \leqq \alpha 2 \leqq 22°$, and $15° \leqq \alpha 3 \leqq 22°$, respectively.

The razor constituted as described above was obtained as a result of performing operating testing in accordance with human life engineering.

What is claimed is:

1. A razor for shaving a skin surface, the razor comprising:

a razor head including a side;

a blade including a blade edge disposed along the side of the razor head;

a handle having a front surface at the same side as the blade edge of the razor head, a rear surface opposite to the front surface, and a side surface between the front surface and the rear surface, in which a gripping section linearly extending in the range from the upper section of the side close to the blade edge up to the lower section of the side far from the blade edge are formed on the handle, wherein:

the entire length along the longitudinal direction of the gripping section and including the razor head and the handle is L, and L satisfies the relation of $108\ \text{mm} \leqq L \leqq 138\ \text{mm}$, the entire width between both ends of the razor head in the cross direction of the blade edge is W, and W satisfies the relation of $34\ \text{mm} \leqq W \leqq 44\ \text{mm}$, the angle formed between the shaving tangential plane on the razor head when applying the razor head to a skin surface together with the blade edge and a plane including the center line in the longitudinal direction of the gripping section of the handle is $\theta$, and $\theta$ satisfies the relation of $11° \leqq \theta \leqq 33°$, the maximum distance in the cross direction between the front surface and the rear surface of two directions orthogonal to each other on a cross section orthogonal to the longitudinal direction of the gripping section of the handle is DX, and the maximum distance in the cross direction between both side surfaces is DY, DX satisfies the relation of $9.5\ \text{mm} \leqq DX \leqq 13.5\ \text{mm}$ and DY satisfies the relation of $9\ \text{mm} \leqq DY \leqq 13\ \text{mm}$, and the whole mass including the razor head and the handle is M, and M satisfies the relation of $8.5\ \text{g} \leqq M \leqq 11.5\ \text{g}$.

2. A handle for a razor having a blade edge, the razor comprising:

a hard section including a first contact section made of a first material and a soft section including a second contact section made of a second material softer than the first material;

a front surface at the same side as the blade edge of the razor, a rear surface opposite to the front surface, a side surface between the front surface and the rear surface extending in the longitudinal direction in the range from the upper section of a side close to the blade edge up to the lower section of a side far from the blade edge, a second rear contact section of the soft section exposed on the rear surface and extending in the longitudinal direction, a first front contact section of the hard section exposed at the boundary section between the front surface and the side surface and extending in the longitudinal direction, a second front contact section of the soft section exposed between first front contact sections at the boundary section between the front surface and the side surface and extending in the longitudinal direction, a second side contact section of the soft section exposed at the boundary section with the front surface on the side surface, extending in the longitudinal direction, and continuing from the second rear contact section, a first side contact section exposed at the boundary section with the front surface on the side surface, extending in the longitudinal direction, and continuing from the first rear contact section, and a boundary line section exposed between the second side contact section and the first side contact section and extending in the longitudinal direction.

3. The handle for the razor according to claim 2, wherein the hard section including the first front contact section and the first side contact section is integrally formed, the soft section including the second rear contact section, the second front contact section, and the second side contact section is integrally formed and the hard section and the soft section are overlapped with each other.

4. The handle of the razor according to claim 2, wherein a finger applying concave section is formed at the upper section of the rear surface close to the blade edge of the razor in the second rear contact section.

5. The handle of the razor according to claim 4, wherein the concave area extending in the longitudinal direction is formed between the first front contact sections on the hard section exposed at the upper section of the front close to the blade edge of the razor.

6. The handle of the razor according to claim 5, wherein cleat protrusions are formed on the second rear contact section, first front contact section, second front contact section, second side contact section, and first side contact section.

7. The handle of the razor according to claim 6, wherein the second front contact section protrudes beyond a virtual plane connecting the first front contact sections to each other at both boundary sections.

8. The handle of the razor according to claim 2, wherein a finger hooking section is formed at the lower end of the side far from the blade edge on the front surface of the handle.

* * * * *